US006176129B1

(12) United States Patent
Aguesse et al.

(10) Patent No.: US 6,176,129 B1
(45) **Date of Patent: *Jan. 23, 2001**

(54) METHOD AND APPARATUS FOR ACQUIRING DATA IN A HYDROCARBON WELL

(75) Inventors: Laurent J. Aguesse, Paris; Gilles C. Cantin, Verrieres le Buisson; Philippe R. Parent, Chilly-Mazarin; Patrick P. Vessereau, Hericy, all of (FR)

(73) Assignee: Schlumberger Technology Corporation, Ridgefield, CT (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/044,722

(22) Filed: Mar. 19, 1998

(30) Foreign Application Priority Data

Mar. 20, 1997 (FR) ..... 97 03422

(51) Int. Cl.[7] ..... G01N 27/00; E21B 47/00

(52) U.S. Cl. ..... 73/152.31; 73/152.29; 73/152.42

(58) Field of Search ..... 73/152.29, 152.31, 73/152.42; 166/241.1, 214

(56) References Cited

U.S. PATENT DOCUMENTS

| | | | | |
|---|---|---|---|---|
| 4,928,758 | | 5/1990 | Siegfried, II | 166/66 |
| 4,974,446 | * | 12/1990 | Vigneaux | 73/152.42 |
| 5,251,479 | * | 10/1993 | Siegfried, II et al. | 73/152.29 |
| 5,318,129 | | 6/1994 | Wittrisch | 166/336 |
| 5,631,413 | * | 5/1997 | Young et al. | 73/152.29 |
| 5,736,637 | * | 4/1998 | Evans et al. | 73/152.31 |

FOREIGN PATENT DOCUMENTS

| | | |
|---|---|---|
| 0 363 011 | 4/1990 | (EP) . |
| 0 683 304 | 11/1995 | (EP) . |
| 0 733 780 | 9/1996 | (EP) . |
| 0 809 098 | 11/1997 | (EP) . |
| 2 700 806 | 7/1994 | (FR) . |
| 2 294 074 | 4/1996 | (GB) . |
| 96/23957 | 8/1996 | (WO) . |

* cited by examiner

*Primary Examiner*—Hezron Williams
*Assistant Examiner*—Michael Cygan
(74) *Attorney, Agent, or Firm*—William B. Batzer

(57) ABSTRACT

In a hydrocarbon well, a speed measurement is performed at substantially the same level as a determination of the proportions of the phases of the fluid flowing along the well in at least one local region. To this end, local sensors are placed on the hinged arms of a centering device, and a speed-measuring spinner is placed between the arms.

20 Claims, 3 Drawing Sheets

METHOD AND APPARATUS FOR ACQUIRING DATA IN A HYDROCARBON WELL

The invention relates to a method and to apparatus for acquiring data and intended for use in a hydrocarbon well. More particularly, the method and the apparatus of the invention are designed to monitor production parameters in a hydrocarbon well and to enable diagnosis to be performed in the event of an incident.

To perform monitoring and diagnostic functions in a hydrocarbon well that is in production, a certain amount of data, mainly physical data needs to be acquired. The data relates essentially to the multiphase fluid flowing along the well (flow rate, proportions of the various phases, temperature, pressure, etc.). The data may also concern certain characteristics of the well proper (ovalization, deviation, etc.). Depending on the type of apparatus used, the information collected downhole can be transmitted to the surface either in real time, or in deferred manner. For real time transmission, the transmission can take place via a telemetry system using the cable from which the apparatus is suspended. For deferred transmission, the information collected downhole is recorded within the apparatus and it is read only once the apparatus has been brought back to the surface.

Whatever the way in which data acquired downhole is used (real time or in deferred manner), existing data-acquisition apparatus is always made up of a large number of modules disposed end-to-end. In particular, speed or flow rate measurement is always performed in a module that is different from the module that serves to detect the proportions of the various phases present in the fluid, when such detection is performed. More precisely, speed or flow rate measurement is generally performed in the bottom modules of the assembly, whereas the proportions of the various phases of the fluid are determined, if they are determined at all, in a module placed higher up.

This conventional disposition of data-acquisition apparatus used in hydrocarbon wells is illustrated in particular by document EP-A-0 733 780 (FIG. 7).

In existing apparatuses, this increase in the number of modules that are superposed to perform monitoring and to establish diagnoses in the event of anomalies in the well, poses various problems.

Firstly, the fact of the data being acquired at significantly different levels in the well means that interpretation of the data can lead to errors or inaccuracies.

Also, when it is desired to acquire a large amount of data, the above organization leads to building up an apparatus that is particularly long, heavy, and expensive. Length and weight make handling of the apparatus on the surface much more complicated. In addition, after the apparatus has been raised, it needs to be transferred to the surface through a decompression lock and the cost of such a lock increases with increasing length.

An object of the invention is to enable data to be acquired in a hydrocarbon well over a reduced height.

A further object of the invention is to enable data to be acquired in a hydrocarbon well at a lower cost than with conventional techniques.

Another object of the invention is to facilitate interpretation of the data acquired and reduce the risks of error and uncertainty.

According to the invention, there is provided a method of acquiring data in a hydrocarbon well, comprising the steps of measuring, on the flow section, the flow rate of a multiphase fluid flowing along the well in the central region thereof, and determining, at least in a local region situated at substantially the same level, the proportions of the fluid phases present in said local region.

By convention, the term "local region" designates any region or three-dimensional zone corresponding to a subdivision or to a portion of the flow section of the well. Also, the term "substantially at the same level" means that the levels at which the fluid flow rate is measured and at which the proportions of the phases in the fluid are determined can be identical or slightly different. If they are slightly different, the difference between the levels is much less than the difference that would exist if the two operations were performed on distinct modules, one mounted beneath the other.

Because flow rate is measured and the proportions of the phases of the fluid are determined at substantially the same level, the data acquired in this way can be interpreted more reliably and more accurately than is possible with prior art methods. In addition, the resulting reduction in the length of the corresponding apparatus simplifies handling and reduces cost, in particular by reducing the length required for the decompression lock.

In a preferred implementation of the invention, the proportions of the fluid phases present are determined in a plurality of local regions surrounding a central region of the well.

Advantageously, the proportions of the fluid phases present are then determined in a plurality of local regions that are regularly distributed around the central region and that are situated at substantially equal distances therefrom.

Preferably, the flow rate is determined on the section of the well by measuring the speed of the fluid in said central region and by measuring the diameter of the well substantially at the level of each local region.

In a preferred implementation of the invention, the proportions of the fluid phases present are then determined in four local regions distributed at 90° intervals relative to one another around the central region, and the diameter of the well is measured in two orthogonal directions each passing substantially through two of the local regions.

Preferably, when the well is deviated, a reference vertical direction substantially intersecting the axis of the well is also determined.

The invention also provides an apparatus for acquiring data in a hydrocarbon well, comprising flow rate measuring means on the flow section for measuring the flow rate of a multiphase fluid flowing along the well in the central region thereof, and at least one local sensor situated substantially at the same level as the flow rate measuring means, each local sensor being suitable for determining the proportions of the phases of the fluid in which it is immersed.

In a preferred embodiment of the invention, the flow rate measuring means comprise means for measuring speed. Centering means then automatically hold the speed-measuring means in a central region of the well, with a plurality of local sensors being disposed around the speed-measuring means.

Advantageously, the local sensors are regularly distributed around the speed-measuring means and are situated at substantially equal distances from said means. The centering means comprise at least three arms in the form of hinged V-linkages, a top end of each being pivotally mounted on a central body carrying the speed-measuring means between the articulated arms, and a bottom end of each being hinged to a moving bottom endpiece. Resilient means are interposed between the central body and each of the articulated arms to press the arms against the wall of the well. In addition, each of the articulated arms carries one of the local sensors substantially at the level of the speed-measuring means.

Advantageously, the centering means comprise four arms at 90° intervals relative to another around a longitudinal axis of the central body.

Preferably, the flow rate measuring means further comprise means for measuring the diameter of the well between each diametrically opposite pair of arms about the longitudinal axis of the central body.

In particular, the means for measuring well diameter may comprise two differential transformers supported by the central body.

When the well is deviated, means, likewise supported by the central body, may also be provided to determine a reference vertical direction substantially intersecting the longitudinal axis of the central body.

These means for determining a reference vertical direction advantageously comprise a flyweight potentiometer.

BRIEF DESCRIPTION OF THE DRAWINGS

A preferred embodiment of the invention is described below by way of non-limiting example and with reference to the accompanying drawings, in which.

DETAILED DESCRIPTION OF A PREFERRED EMBODIMENT

Figure 1:
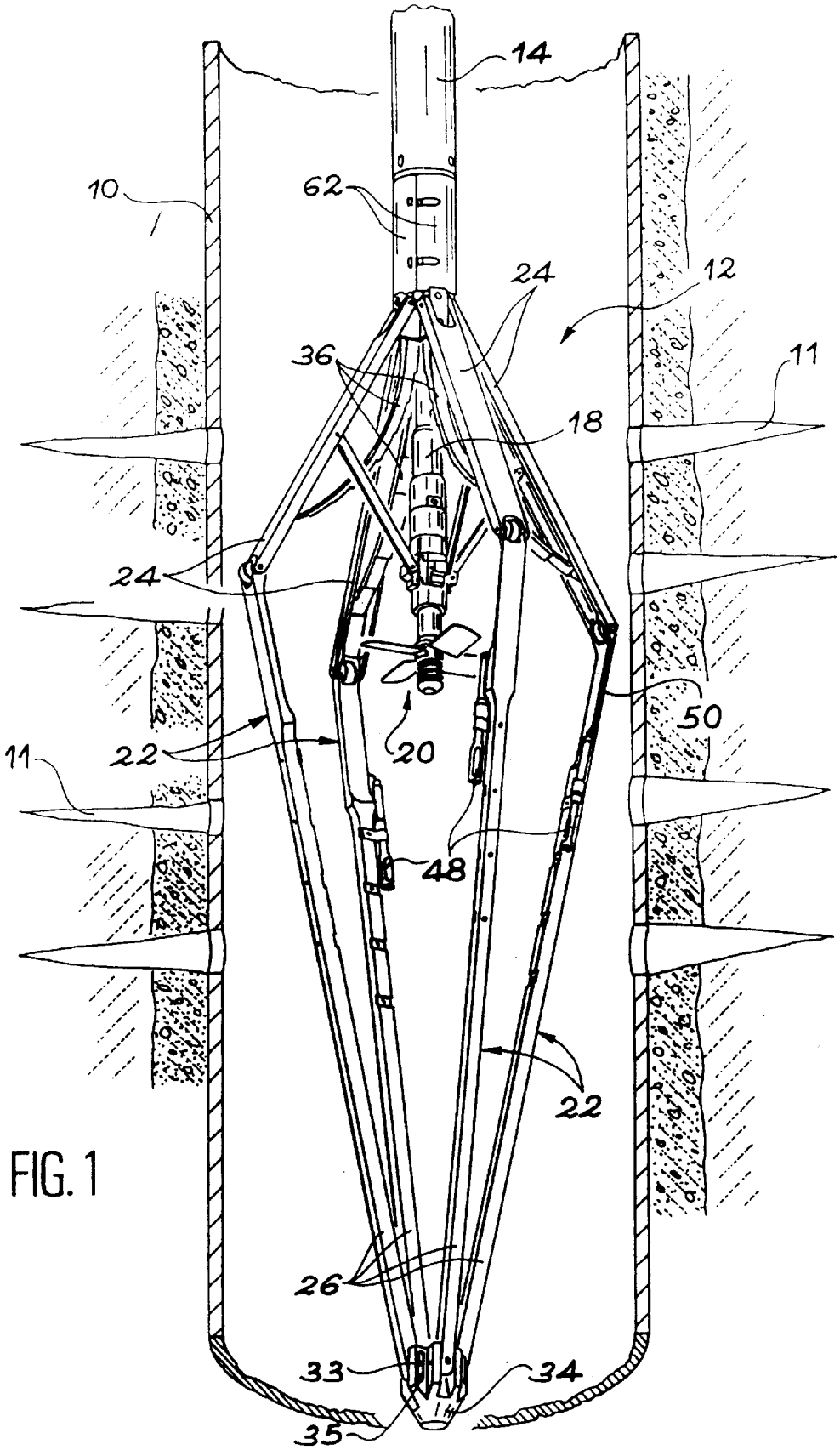
FIG. 1 is a perspective view showing data-acquisition apparatus of the invention placed in a hydrocarbon well.

In FIG. 1, reference 10 designates a length of a hydrocarbon well in production. This length 10 is provided with perforations 11 through which fluid flows from the field into the well, and it is shown in longitudinal section so as to show clearly the bottom portion of data-acquisition apparatus 12 made in accordance with the invention.

The data-acquisition apparatus 12 of the invention is suspended from the surface inside the well 10 by means of a cable (not shown). The data acquired in the apparatus 12 is transmitted in real time to the surface, by telemetry, along the cable.

The top portion of the data-acquisition apparatus 12, which does not form part of the invention, includes a certain number of sensors such as pressure sensors and temperature sensors. It also includes a telemetry system.

The bottom portion of the data-acquisition apparatus 12, in which the invention is located, is described below with reference to FIGS. 1 to 3.

As shown in the figures, the apparatus 12 comprises a tubular envelope 14 whose axis is designed to coincide approximately with the axis of the well 10. When the apparatus is in the operating state, the tubular envelope 14 is closed at each of its ends by a leakproof plug.

Figure 3:
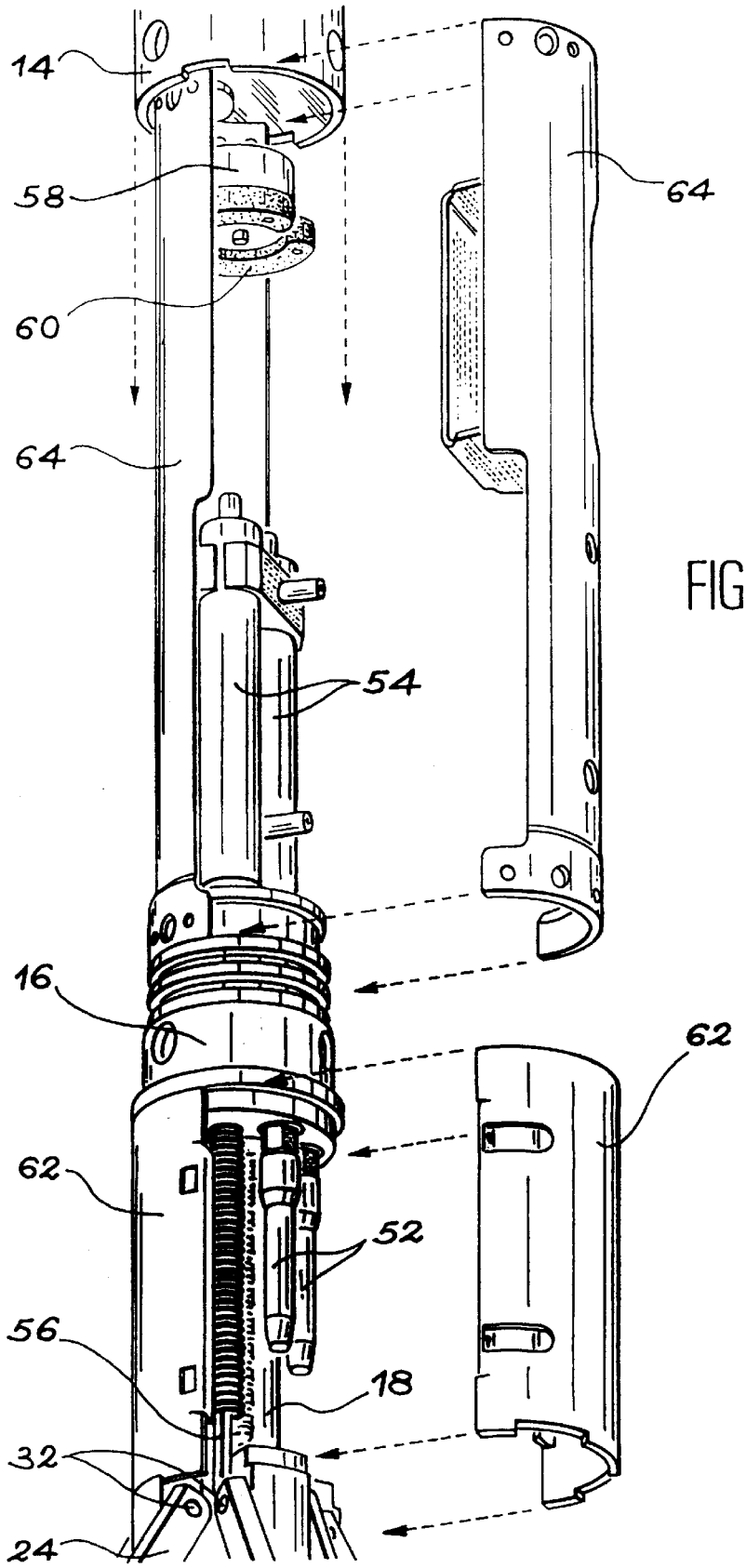
FIG. 3 is a perspective view on a larger scale showing the top portion of the FIG. 1 apparatus, prior to the protective caps and the tubular envelope being put into place.

In FIG. 3, which shows the top portion of FIG. 1 when the apparatus is partially disassembled to reveal certain component elements thereof, the tubular envelope 14 is slid upwards and its bottom plug is given reference 16. Plugs are assembled to the ends of the envelope 14, e.g. by means of screws and sealing rings (not shown) in such a manner that the inside space defined in this way is isolated in sealed manner from the outside. This inside space can thus be maintained at atmospheric pressure, regardless of the pressure in the well.

The bottom plug 16 is extended downwards by a central body 18 extending along the axis of the tubular envelope 14 of the apparatus. At its bottom end, the central body 18 carries speed-measuring means constituted by a spinner 20 whose axis coincides with the axis of the envelope 14 and of the central body 18. The spinner 20 measures the speed of the fluid flowing along the well without altering the shape of the flow section thereof.

The axis common to the spinner 20, to the envelope 14, and to the central body 18 constitutes the longitudinal axis of the apparatus. It is automatically held in a central region of the well 10, i.e. substantially on the axis thereof, by centering means. In the embodiment shown, these centering means comprise four arms 22 in the form of hinged V-linkages, that are distributed at 90° intervals relative to one another about the longitudinal axis of the appliance.

Figure 2:
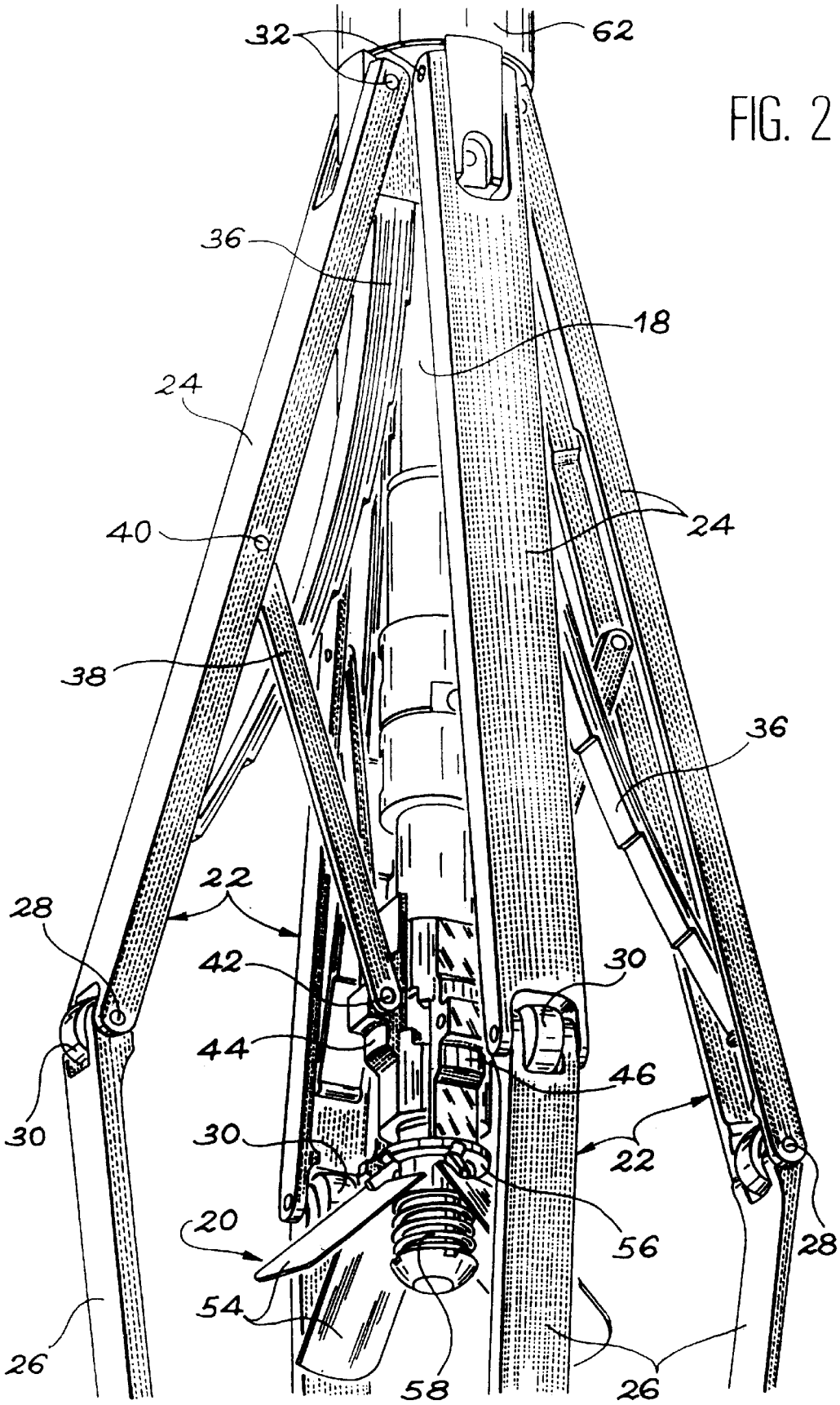
FIG. 2 is a perspective view on a larger scale showing the middle portion of the FIG. 1 apparatus, in which flow rate is measured.

More precisely, and as shown in particular in FIGS. 1 and 2, each arm 22 comprises a top link 24 and a bottom link 26 that are hinged together about a pin 28. The pin 28 carries a small wheel or roller 30 through which the corresponding arm 22 normally presses against the wall of the well 10.

At its top end each of the two links 24 is hinged to the central body 18 about a pin 32. As shown in particular in FIG. 3, all of the hinge pins 32 are situated at the same height, at a relatively short distance beneath the bottom plug 16.

Also, and as shown in FIG. 1, the bottom ends of the bottom links 26 of the arms 22 are pivotally mounted to a moving bottom endpiece 34 which constitutes the bottom end of the apparatus. More precisely, two opposite bottom links 26 are hinged with practically no play to the bottom endpiece 34 by pins 33, while the other two bottom links 26 are hinged to the same endpiece 34 via pins 33 that are free to slide in longitudinal slots 35 formed in the endpiece. This disposition makes it possible for the wheels or rollers 30 to bear continuously against the wall of the well 10, even when the section of the well is not accurately circular.

As shown in particular in FIGS. 1 and 2, leaf springs 36 are inteposed between the central body 18 and each of the arms 22, so as to hold the arms permanently spread apart from the central body 18, i.e. pressing against the wall of the well 10, when the apparatus is placed therein. To this end, the top ends of the leaf springs 36 are secured to the central body 18 close to the hinge pins 32, while their bottom ends are hinged to the top links 24 close to their hinge pins 28. The mechanism also has reinforcing links 38 inteposed between each of the top links 24 and central body 18 in the vicinity of its bottom end carrying the spinner 20.

More precisely, the top end of each reinforcing link 38 is hinged to the central portion of a corresponding top link 24 by a pin 40. Also, the bottom ends of the reinforcing links 38 and associated with diametrically opposite arms 22 are hinged via pins 42 to two slideably mounted parts 44 and 46 that can move independently of each other on the central body 18. Like the hinge arrangement described above for the bottom links 26 and the bottom endpiece 34, this disposition allows the wheels or rollers 30 of all of the arms 22 to press against the wall of the well 10, even if the well is not accurately circular.

As shown in FIG. 1, each of the arms 22 is used to carry a local sensor 48 (one of these sensors is hidden by the arm carrying it). More precisely, the local sensors 48 are all fixed at the same level to the bottom links 26 of the arms 22, and this level is chosen to be substantially the same as the level of the spinner 20 used for measuring speed. In the embodiment shown, the local sensors 48 are at a level slightly lower than the level of the spinner 20. However, the difference between these levels is always much less than the difference that would exist if the local sensors and the spinner were mounted on distinct modules, placed one beneath the other.

Because of the way they are mounted on the arms 22, the local sensors 48 are regularly distributed around the spinner 20 used for measuring speed, and they are situated at substantially equal distances from said spinner.

The local sensors may be constituted by any sensor suitable for determining the proportions of the fluid phases present in the local region surrounding the sensitive portion thereof. By way of example, the local sensors 48 may be constituted, in particular, by conductivity sensors, of the kind described in document EP-A-0 733 780, or optical sensors, as described in document EP-A-0 809 098. Each of the local sensors 48 is connected by a cable 50 to a connector 52 (FIG. 3) which projects downwards from the bottom face of the plug 16. It should be observed that in FIG. 3 where the apparatus is shown partially disassembled, the connectors 52 are shown protected by thimbles. The electronic circuits associated with the local sensors 48 are placed inside the tubular envelope 14 and they are connected to the connectors 52 by other cables (not shown).

To enable speed to be measured and to discover the direction of flow, the spinner 20 is constrained to rotate with a shaft (not shown) which carries a certain number of permanent magnets (e.g. six permanent magnets) at its top end, which magnets are in the form of cylinders extending parallel to the axis of the central body 18. These magnets are all at the same distance from the axis of the central body 18 and they are regularly distributed around said axis. Above these permanent magnets, the central body 18 carries two pickups that are slightly angularly offset relative to each other and past which the magnets travel. The shaft of the spinner 20 and the magnets are placed in a cavity of the central body 18 which is at the same pressure as the well. In contrast, the pickups are received in a recess that is isolated from the above-mentioned cavity by a sealed partition so as to be permanently at atmospheric pressure. Electrical conductors connect the pickups to circuits placed inside the tubular envelope 14.

As shown in FIG. 2, the blades 54 of the spinner 20 are mounted on the central body 18 in such a manner as to be capable of folding downwards when the arms 22 are themselves folded down onto the central body 18.

To this end, each of the blades 54 of the spinner 20 is hinged at its base to the central body 18 and it co-operates via a camming surface (not shown) with a ring 56 slidably mounted on the central body. A spring 58 is inteposed between the ring 56 and a collar forming the bottom end of the central body 18. The spring 58 normally holds the ring 56 in its high position so that the blades 54 of the spinner 20 extend radially as shown in FIG. 1. When the arms 22 are folded down, as shown in FIG. 2, at least one of the parts 44 and 46 bears against the ring 56 to urge it downwards against the reaction of the spring 58. This downward movement of the ring 56 has the effect of causing the blades 54 to pivot downwards as well, as shown in FIG. 2.

In the preferred embodiment shown in FIG. 3, in particular, the data-acquisition apparatus further includes means for measuring the diameter of the well between each pair of diametrically-opposite arms 22. Together with the speed-measuring means constituted by the spinner 20, these diameter-measuring means constitute means for measuring the flow rate of the multiphase fluid flowing along the well. The diameter-measuring means comprise two transformers 54 received inside the tubular envelope 14 and carried by the bottom plug 16 secured to the central body 18. These transformers 54 are linear differential transformers and the moving bottom portions 56 thereof project downwards beneath the bottom plug 16 so as to be driven by respective different pairs of the arms 22.

The transformers 54 thus serve to measure two mutually perpendicular diameters of the well 10. This provides information relating to possible ovalization of the well in the zone where measurements are being performed.

In the embodiment shown in FIG. 3, means constituted by a rheostat 58 associated with a flyweight 60 are also housed in the tubular envelope for the purpose of determining a reference vertical direction substantially intesecting the longitudinal axis of the apparatus 14, when the well is deviated.

More precisely, the rheostat 58 having a flyweight 60 is housed in the tubular envelope 14 above the transformers 54 so that its axis coincides with the axis of the envelope. As soon as the axis of the tubular envelope 14 tilts because the well in which the apparatus is located is itself deviated, the flyweight 60 of the rheostat 58 automatically orients itself downwards. The signal delivered by the rheostat 58 then depends on the orientation of the vertical relative to the central body 14 of the apparatus. The reference vertical direction obtained in this way serves in particular to determine the three-dimensional location of each of the local sensors 48 and also the location of each of the two diameters as measured by the pairs of arms 22 and the transformers 54. Correlation can thus be performed without difficulty between the various measurements performed.

As also shown in FIG. 3, the zone surrounding the central body 18 between the bottom plug 16 and the hinge pins 32 of the top links 24 is normally protected by two removable half-covers 62. This zone contains the connectors 52 and the moving portions 56 of the transformers 54. As already mentioned, this is a zone that is at well pressure.

Also, the flyweight rheostat 58 is mounted inside the tubular envelope 14 via two removable half-tubes 64 fixed at their bottom ends to the bottom plug 16. The transformers 54 are located inside the half-tubes 64 which are themselves housed in the tubular envelope 14 when it is fixed in sealed manner on the bottom endpiece 16.

Naturally, the apparatus described above can be modified without going beyond the ambit of the invention. Thus, the rheostat 58 serving to determine a reference vertical direction may be omitted or replaced by any equivalent device. The same applies to the transformers 54 which are used for measuring two mutually orthogonal diameters of the well. The apparatus may also be centered in the well in different manner, e.g. by means of a mechanism having only three articulated arms.

What is claimed is:

1. A method of acquiring data in a hydrocarbon well, comprising the steps of placing a data-acquisition apparatus, having centering means, a least one local sensor, and a flow speed-measuring means, within the hydrocarbon well;

allowing a multiphase fluid to flow past said data-acquisition apparatus;

operating the centering means, thereby centering said speed-measuring means in the central region of the well and positioning said at least one local sensor at substantially the same level in the longitudinal direction as said centering means;

measuring the speed of the multiphase fluid flowing past said hydrocarbon well using said speed-measuring means;

determining proportions of fluid phases present within the multiphase fluid using said local sensor.

2. A method according to claim 1, in which the proportions of the fluid phases present are determined in a plurality of local regions surrounding said central region.

3. A method according to claim 2, in which the proportions of the fluid phases present are determined in a plurality of local regions that are regularly distributed around the central region and that are situated at substantially equal distances therefrom.

4. A method of acquiring data in a hydrocarbon well, comprising the steps of placing a data-acquisition apparatus, having centering means, a least one local sensors, a flow speed-measuring means, and means for measuring the well diameter within the hydrocarbon well;

allowing a multiphase fluid to flow past said data-acquisition apparatus;

operating the centering means, thereby centering said speed-measuring means means in the central region of the well and positioning said speed-measuring means, said well diameter measuring means and said local sensors at substantially the same level in the longitudinal direction as said centering means;

measuring the speed of the multiphase fluid flowing past said hydrocarbon well using said speed-measuring means;

measuring the diameter of the well at substantially that level in the longitudinal direction;

determining proportions of fluid phases present within the multiphase fluid using said at least one local sensor.

5. A method according to claim 4, in which the proportions of the fluid phases present are determined in four local regions distributed at 90° intervals relative to one another around the central region, and the diameter of the well is measured in two orthogonal directions each passing substantially through two of the local regions.

6. A method of acquiring data in a hydrocarbon well, comprising the steps of placing a data-acquisition apparatus, having centering means, a least one local sensors, a flow speed-measuring means, and means for measuring a possible ovalization of the well, within the hydrocarbon well;

allowing a multiphase fluid to flow past said data-acquisition apparatus;

operating the centering means, thereby centering said speed-measuring means and positioning said speed-measuring means in the central region of the well, said means for measuring means a possible ovalization of the well and said local sensors at substantially the same level in the longitudinal direction as said centering means;

measuring the speed of the multiphase fluid flowing past said hydrocarbon well using said speed-measuring means;

measuring possible ovalization of the well;

determining proportions of fluid phases present within the multiphase fluid using said at least one local sensor.

7. A method of acquiring data in a hydrocarbon well, comprising the steps of placing a data-acquisition apparatus, having centering means, a least one local sensor, and A flow speed-measuring means, within the hydrocarbon well;

allowing a multiphase fluid to flow past said data-acquisition apparatus;

operating the centering means, thereby centering said speed-measuring means in the central region of the well and positioning said at least one local sensor at substantially the same level in the longitudinal direction as said centering means;

measuring the speed of the multiphase fluid flowing past said hydrocarbon well using said speed-measuring means;

determining proportions of fluid phases present within the multiphase fluid using said local sensor; and determining a reference vertical direction.

8. Apparatus for acquiring data in a hydrocarbon well, comprising speed-measuring means for measuring over the flow section of the well the speed of a multiphase fluid flowing along the well in the central region thereof, centering means for holding the speed-measuring means in the central region of the well and at least one local sensor, each local sensor being suitable for determining the proportions of the phases of the fluid in which it is immersed and whereby the speed-measuring means, the centering means and the local sensors are situated substantially at the same level in the longitudinal direction of the well.

9. Apparatus according to claim 8 comprising a plurality of local sensors regularly distributed around the speed-measuring means, at substantially equal distances from said speed measuring means.

10. Apparatus according to claim 9, in which the centering means comprise at least three arms in the form of hinged V-linkages, a top end of each being pivotally mounted on a central body carrying the speed-measuring means between the articulated arms, and a bottom end of each being hinged to a moving bottom endpiece, resilient means being interposed between the central body and each of the articulated arms to press the arms against the wall of the well, and each of the articulated arms carrying one of the local sensors substantially at the level of the speed-measuring means.

11. Apparatus according to claim 10, in which the centering means comprise four arms at 90° intervals relative to another around a longitudinal axis of the central body.

12. Apparatus according to claim 11, in which the speed measuring means further comprise means for measuring the diameter of the well between each diametrically opposite pair of arms about said longitudinal axis.

13. Apparatus according to claim 12, in which the means for measuring well diameter comprise two differential transformers supported by the central body.

14. Apparatus according to claim 10, in which means housed in the central body are provided to determine a reference vertical direction substantially intersecting the longitudinal axis of the central body, when the well is deviated.

15. Apparatus according to claim 14, in which the means for determining a reference vertical direction comprise a potentiometer (58) having a flyweight (60).

16. Apparatus for acquiring data in a hydrocarbon well, comprising speed-measuring means for measuring over the flow section of the well the speed of a multiphase fluid flowing along the well in the central region thereof, centering means for holding the speed-measuring means in the central region of the well and at least one local conductivity sensor, each local sensor being suitable for determining the proportions of the phases of the fluid in which it is immersed and whereby the speed-measuring means, the centering means and the local sensors are situated substantially at the same level in the longitudinal direction of the well.

17. Apparatus for acquiring data in a hydrocarbon well, comprising speed-measuring means and well diameter measuring means for measuring over the flow section of the well the flow rate of a multiphase fluid flowing along the well in the central region thereof, centering means for holding the speed-measuring means in the central region of the well and at least one local sensor, each local sensor being suitable for determining the proportions of the phases of the fluid in which it is immersed and whereby the speed-measuring means, the centering means and the local sensors are situated substantially at the same level in the longitudinal direction of the well.

18. Apparatus for acquiring data in a hydrocarbon well comprising:

A spinner that mechanically measures the speed of a multiphase fluid flowing though the hydrocarbon well at a central location within the hydrocarbon well;

A plurality of local sensors that determine proportions of fluid phases present within the multiphase fluid;

A mechanical assembly having a plurality of arms and a plurality of wheels or rollers, that when deployed, positions said spinner at the central location within the hydrocarbon well and positions said local sensors into a plurality of local regions at substantially the same level in the longitudinal direction as the central location and brings said wheels or rollers into contact with the wall of said hydrocarbon well.

19. Apparatus for acquiring data in a hydrocarbon well comprising:

A spinner that mechanically measures the speed of a multiphase fluid flowing though the hydrocarbon well at a central location within the hydrocarbon well;

A plurality of local sensors that determine proportions of fluid phases present within the multiphase fluid;

A mechanical assembly having a plurality of arms and a plurality of wheels or rollers, that when deployed, positions said spinner at the central location within the hydrocarbon well and positions said local sensors into a plurality of local regions at substantially the same level in the longitudinal direction as the central location and brings said wheels or rollers into contact with the wall of said hydrocarbon well;

A potentiometer having a flyweight, connected to said mechanical assembly, for determining a reference vertical direction.

20. Apparatus for acquiring data in a hydrocarbon well, comprising:

A spinner that mechanically measures the speed of a multiphase fluid flowing though the hydrocarbon well at a central location within the hydrocarbon well;

A plurality of local sensors that determine proportions of fluid phases present within the multiphase fluid;

A mechanical assembly having a plurality of arms carrying the local sensors and a plurality of wheels or rollers, that when deployed, positions said spinner at the central location within the hydrocarbon well and positions said local sensors into a plurality of local regions at substantially the same level in the longitudinal direction as the central location and brings said wheels or rollers into contact with the wall of said hydrocarbon well.

* * * * *